US005884595A

United States Patent [19]

Haas et al.

[11] Patent Number: 5,884,595

[45] Date of Patent: Mar. 23, 1999

[54] MECHANICAL CUP PUSHROD FOR AN INTERNAL COMBUSTION ENGINE'S VALVE GEAR

[75] Inventors: Michael Haas, Weisendorf; Walter Speil, Ingolstadt, both of Germany

[73] Assignee: Ina Walzlager Schaeffler oHG, Germany

[21] Appl. No.: 973,635

[22] PCT Filed: Mar. 12, 1996

[86] PCT No.: PCT/EP96/01049

§ 371 Date: Dec. 4, 1997

§ 102(e) Date: Dec. 4, 1997

[87] PCT Pub. No.: WO97/05367

PCT Pub. Date: Feb. 13, 1997

[30] Foreign Application Priority Data

Jul. 27, 1995 [DE] Germany ..... 195 27 449.0

[51] Int. Cl.[6] ..... F01L 1/14

[52] U.S. Cl. ..... 123/90.52

[58] Field of Search ..... 123/90.51, 90.48, 123/90.52; 74/569

[56] References Cited

U.S. PATENT DOCUMENTS

| | | | |
|---|---|---|---|
| 2,863,432 | 12/1958 | O'Brien | 123/90 |
| 4,909,198 | 3/1990 | Shiraya et al. . | |
| 5,267,538 | 12/1993 | Speil et al. . | |
| 5,289,804 | 3/1994 | Mori | 123/90.51 |
| 5,372,099 | 12/1994 | Matsunuma et al. | 123/90.48 |
| 5,445,119 | 8/1995 | Regueiro | 123/90.48 |

FOREIGN PATENT DOCUMENTS

| | | |
|---|---|---|
| 209697 | 1/1987 | European Pat. Off. . |
| 596620 | 5/1994 | European Pat. Off. . |
| 4131487 | 3/1993 | Germany . |

OTHER PUBLICATIONS

JP 58–101204 A, Patent Abstracts of Japan; M–241, Sep. 8, 1983, vol. 7, No. 203.

*Primary Examiner*—Wellun Lo
*Assistant Examiner*—Arnold Castro
*Attorney, Agent, or Firm*—Bierman, Muserlian and Lucas

[57] ABSTRACT

Upper and lower contact discs (5, 6) are used for adjusting valve clearance with a mechanical cup tappet (1). The lower contact discs (6) have a substantially larger clearance adjusting range $H_{SW}$ than the upper contact discs (5). In this way, the invention succeeds in further reducing the total mass of the cup tappet (1) because, in an initial mounting of the cup tappet (1), the valve clearance is adjusted through the relatively small lower contact disc (6) and thus with relatively small mass fluctuations.

16 Claims, 1 Drawing Sheet

MECHANICAL CUP PUSHROD FOR AN INTERNAL COMBUSTION ENGINE'S VALVE GEAR

FIELD OF THE INVENTION

The invention concerns a method of adjusting valve clearance with a mechanical cup tappet for a valve gear of an internal combustion engine comprising a hollow cylindrical skirt guided in a reception bore of a cylinder head, a cam-proximate end of the skirt being defined by a disc-shaped bottom, said bottom comprising on a cam-proximate side, an upper, wear-resistant contact disc for the cam, said contact disc extending over a major part of a diameter of the bottom, said bottom comprising on a cam-distal side, a lower contact disc for a stem of a gas exchange valve, a diameter of the lower contact disc being substantially smaller than a diameter of the upper contact disc.

BACKGROUND OF THE INVENTION

Valve tappets of the pre-cited type are used in valve gears of internal combustion engines and serve to transmit a lifting motion of a control cam to a gas exchange valve. It is known in this connection, for example, from U.S. Pat. No. 4,909,198, to arrange both upper and lower contact discs in the region of the bottom of the tappet. In this document, which is considered as species-defining, the lower contact disc serves as a wear protection disc because the tappet housing as a whole is made of a light weight material such as aluminium. The upper contact disc of this prior art document, which has a substantially larger diameter than the lower contact disc, serves not only for an initial adjustment of valve clearance during assembly of the internal combustion engine but also for an adjustment of valve clearance in accordance to the operating periods of the internal combustion engine proposed by the manufacturer. During an initial mounting of the cup tappet already, adjusting ranges of, for instance, up to 3.5 mm fluctuations in thickness have to be realized. Thus, the force of the valve spring which loads the cup tappet towards the cam has to match the highest conceivable mass of the tappet and is thus higher than desirable. These possibly, relatively high oscillating masses of the tappet cause an unnecessary increase of friction work in the valve gear. In the case of subsequent adjustment of valve clearance during maintenance work on the internal combustion engine, the valve clearance is likewise corrected via the upper contact disc which therefore has a solid configuration. This means that upper contact discs in a large number of different thicknesses have to be kept in store by engine manufacturers and servicing stations. The main drawback of the prior art tappet of U.S. Pat. No. 4,909,198, however, is that it has a relatively large mass despite its light weight housing because valve clearance has to be compensated through its upper contact disc which is relatively "solid" compared to the lower contact disc and because it has a large adjusting range.

OBJECT OF THE INVENTION

The object of the invention is to provide a method of adjusting valve clearance with a cup tappet of the pre-cited type in which the mentioned drawbacks are eliminated and, in particular, to reduce the mass of the tappet further, while simultaneously improving ease of mounting and servicing.

SUMMARY OF THE INVENTION

The invention achieves this object by the fact that identical upper contact discs are used in an initial mounting of the cup tappet in the valve gear of all internal combustion engines of a particular type, a valve clearance occurring before the initial mounting of the cup tappet is adjusted to a desired value by lower contact discs having an appropriate thickness, the upper contact disc has an extremely small thickness in keeping only with the required strength properties, and a variation of valve clearance occurring during operation of the internal combustion engine is compensated by upper contact discs having an appropriate thickness. The invention achieves its object alternatively by the fact that valve clearance in an internal combustion engine is adjusted through upper and lower contact discs wherein the ratio between a clearance adjusting range $H_{SW}$ of the lower contact disc and a clearance adjusting range $H_{SE}$ of the upper contact disc is given by $H_{SW}/H_{SE} \geqq 5$, and/or wherein a thickness variation of the upper contact disc is given by $D_{maxE}/D_{minE} \leqq 1.2$, a thickness variation of the lower contact disc being simultaneously given by $D_{maxW}/D_{minW} \leqq 3$.

The aforesaid measures permit a further reduction of the mass of a cup tappet of this type and this can likewise lead to a reduction of the required spring force of the gas exchange valve. Due to the fact that valve clearance, particularly during the initial mounting of the cup tappet, is effected via lower contact discs of variable thickness which have a substantially smaller diameter than the simultaneously used upper contact discs, the strong mass fluctuations of cup tappets hitherto encountered in the prior art no longer have to be reckoned with. The aim is to enable the use of light weight tappets having an extremely small bottom thickness which remains constantly small for all internal combustion engines of a particular type. Since these mass fluctuations in the cup tappets for a particular engine type are no longer that serious, it is possible to reduce the force of the spring of the gas exchange valve because this force no longer has to be matched to the relatively large mass of the thickest conceivable upper contact disc. During servicing of the internal combustion engine, it is then possible to adjust eventually occurring valve clearance through the upper contact disc. However, it is no longer necessary to dispose of upper contact discs in such a variety of thicknesses as in the past because, empirically seen, thickness variations similar to those in the initial mounting no longer have to be reckoned with. It is also possible to configure the upper contact disc so that a replacement thereof is not provided for, in which case, valve clearance occurring during operation of the internal combustion engine is likewise adjusted through the lower contact disc.

The light weight materials usable for the tappets of the invention are, among others, aluminium and aluminium alloys. However, it is also conceivable to reinforce the housing of the tappet with fibers, particles or lattice intercalations, or to provide an adequate wear resistant coating on the outer peripheral surface of the housing.

Since, according to the invention, the main adjusting range of valve clearance is realized via the lower contact disc, it is also conceivable to make the upper contact disc of an engineering ceramic or a hardened steel, or a similar suitable material.

According to a further embodiment of the invention, the lower contact disc can be received in a hollow cylindrical extension of the bottom, or a bore can be arranged in the bottom and the lower contact disc fixed therein.

In still another embodiment of the invention, the lower contact disc is configured as a hollow cylindrical bushing. This enables a further reduction of the total mass of the cup tappet. This bushing can be configured so that it partially assumes the function of the valve stem of the gas exchange valve due to its length.

Further sub-claims concern simple means for positionally fixing the lower contact disc. For example, the lower contact disc or the bushing, as the case may be, can comprise an annular element on its outer peripheral surface so as to fix it in the bore or the extension. Alternatively, radially inwards extending projections can be provided on the extension or the bore, by which the lower contact disc or the bushing can be force-locked in place.

The invention is not limited to the features of the claims. Rather, combinations of individual features of the claims with one another and with features set forth in the specification are both conceivable and intended.

DETAILED DESCRIPTION OF THE DRAWINGS

Figure 1:
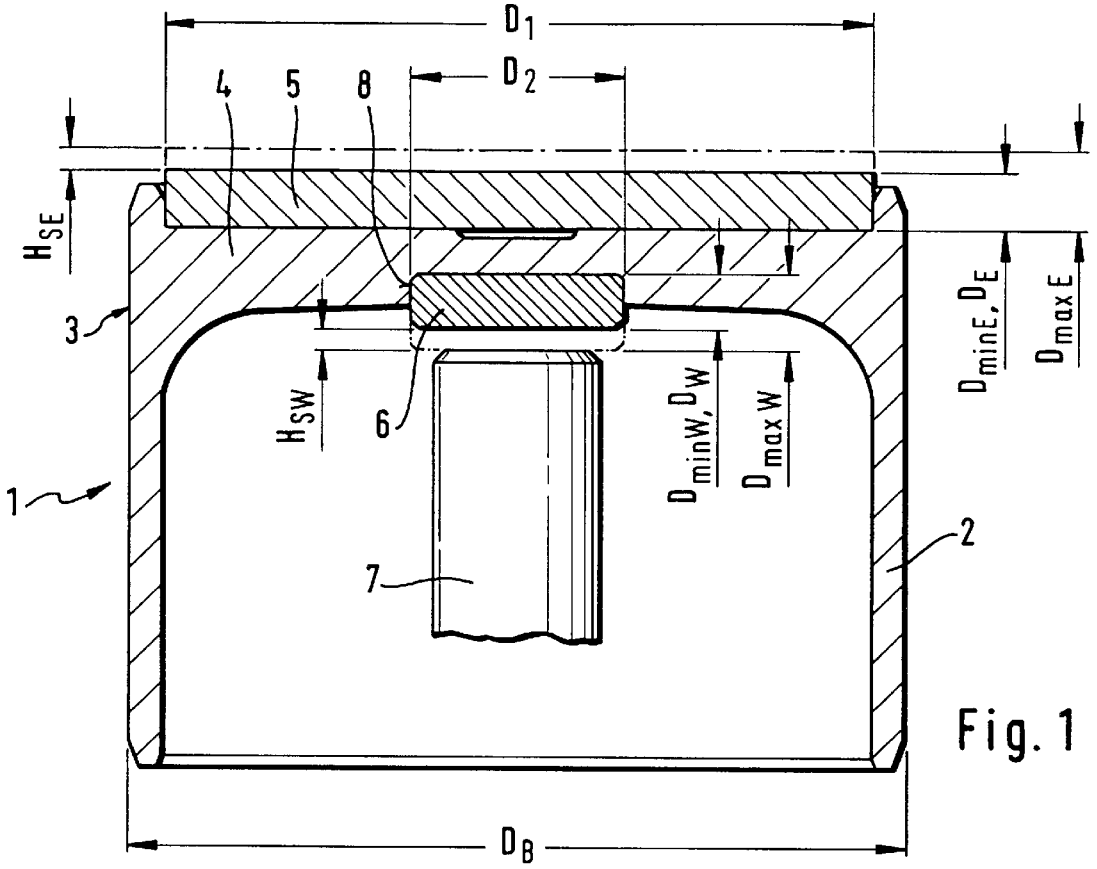
FIG. 1 is a longitudinal section through a cup tappet of the invention.

FIG. 1 shows a cup tappet 1 known, per se, in the technical field and comprising a hollow cylindrical skirt 2 which is closed at its cam-proximate end 3 by a disc-shaped bottom 4. On one side, this bottom 4 comprises a wear-resistant upper contact disc 5 which extends over a major part of a diameter $D_B$ of the cup tappet 1. The contact disc 5 is loaded by a cam of a camshaft, not shown, so that the entire cup tappet 1 follows the lifting motion of this cam. On a cam-distal side of the bottom 4 there is arranged a further, lower contact disc 6 in a central position. This contact disc 6 is in direct contact with a stem 7 of a gas exchange valve.

A diameter $D_2$ of the lower contact disc 6 is substantially smaller than a diameter $D_1$ of the upper contact disc 5. At the same time, the bottom 4 of the cup tappet 1 and the upper contact disc 5 have an extremely small thickness in keeping only with the required strength properties. An adjustment of valve clearance during the initial mounting of the cup tappet 1 is effected via the lower contact disc 6. As already set forth in the summary of the invention, a result of this is that large fluctuations of the mass of the cup tappets 1 used in one particular type of internal combustion engine are no longer encountered because valve clearance is compensated via the lower contact disc 5 which has a substantially smaller diameter (for example, 3 times smaller). In the case of servicing, the upper contact disc 5 can be exchanged, the ratio between the clearance adjusting range $H_{SW}$ of the lower contact disc 6 and the clearance adjusting range $H_{SE}$ of the upper contact disc 5 being given by: $H_{SW}/H_{SE} \geqq 5$. This means in other words, that the lower contact disc 6 has a much larger clearance adjusting range than the upper contact disc 5 so that upper contact discs 5 with only slightly graded thicknesses are required for servicing purposes. Thus, the invention provides an adjustment of valve clearance both through the upper and the lower contact disc 5, 6, the larger adjusting range which, from experience, has to be bridged during the initial mounting of the cup tappet 1, being realized in the lower contact disc 6. Thus, the invention succeeds in reducing the total mass of the cup tappet 1 further because the maximum possible valve clearance is no longer compensated via the upper contact disc 5 having a relatively large diameter but via the lower contact disc 6.

Figure 2A:
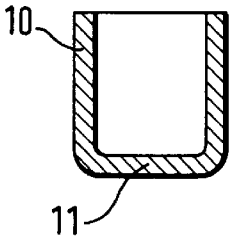
FIGS. 2*a, b* are cross sections through a lower contact disc configured as a bushing.
Figure 3:
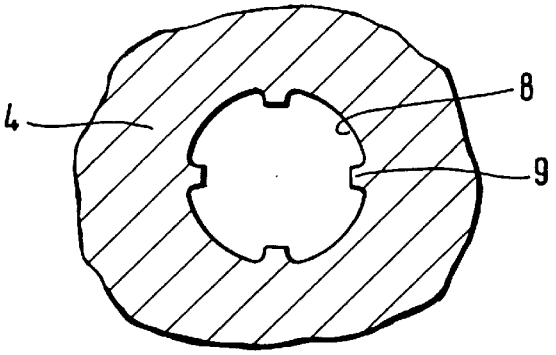
FIG. 3 is a partial bottom view of the cup tappet of FIG. 1 in the region of its bore for the lower contact disc.

It is conceivable to fix the lower contact disc 6 in a bore 8 of the bottom 4 by force-locking. As shown in FIG. 3, this can be achieved by claw-like projections 9 extending radially inwards from the bore 8. It is likewise conceivable, as shown in FIGS. 2*a, b,* to configure the lower contact disc 6 as a hollow cylindrical bushing 10 whose bottom 11 is in direct contact with an end of the stem 7 of the gas exchange valve.

Figure 2B:
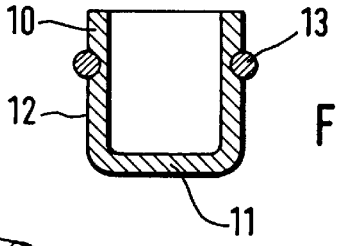

To improve the positional fixing of this bushing 10, it is also possible as shown in FIG. 2*b,* to arrange an annular element 13 on the outer peripheral surface 12 of the bushing 10 which force-locks the bushing 10 in the bore 8. However, it is also conceivable to make a complementary recess for the annular element 13 in the bore 8 so that the bushing 10 is additionally retained in a form-fitted manner.

Reference Numbers and Symbols

1 Cup tappet
2 Skirt
3 End
4 Bottom
5 Upper contact disc
6 Lower contact disc
7 Stem
8 Bore
9 Projections
10 Bushing
11 Bottom
12 Outer peripheral surface
13 Annular element
$D_B$—Diameter, bottom, cup tappet
$D_1$—Diameter, upper contact disc
$D_2$—Diameter, lower contact disc
$D_E$—Thickness, upper contact disc
$D_{minE}$—Minimum thickness, upper contact disc
$D_{maxE}$—Maximum thickness, lower contact disc
$H_{SE}$—Clearance adjusting range, upper contact disc
$D_W$—Thickness, lower contact disc
$D_{minW}$—Minimum thickness, lower contact disc
$D_{maxW}$—Maximum thickness, lower contact disc
$H_{SW}$—Clearance adjusting range, lower contact disc

We claim:

1. A method of adjusting a first and second valve clearance of a mechanical cup tappet (1) in a valve gear of an internal combustion engine, whereby said first valve clearance occurs at an initial mounting of said tappet (1) and said second valve clearance occurs after a period of operation of said combustion engine, said valve gear having a mechanical cup tappet (1) with a hollow cylindrical skirt (2) guided in a reception bore of a cylinder head, a cam-proximate end (3) of the skirt (2) being defined by a disc-shaped bottom (4), said bottom (4) having on a cam-proximate side, an upper, wear-resistant contact disc (5) for the cam, said upper contact disc (5) extending over a major part of a diameter $D_B$ of the bottom (4), said bottom (4) having on a cam-distal side, a lower contact disc (6) for a stem (7) of a gas exchange valve, a diameter $D_2$ of the lower contact disc (6) being substantially smaller than a diameter $D_1$ of the upper contact disc (5), comprising:

(a) during adjustment of said first valve clearance, installing identical upper contact discs (5) into the valve gears of all internal combustion engines of a particular type, and installing lower contact discs (6) for reducing of said first valve clearance to a desired value, said lower contact discs (6) having an appropriate thickness $D_W$, the upper contact discs (5) having an extremely small thickness $D_E$ in keeping only with required strength properties and (b) during adjustment of said second valve clearance, a valve clearance is compensated by replacement of said upper contact discs (5) with another contact disc (5) having an appropriate thickness $D_E$.

2. A method of adjusting valve clearance with a cup tappet according to the preamble of claim 1, characterized in that valve clearance in an internal combustion engine is adjusted through upper and lower contact discs (5, 6) wherein a ratio between a clearance adjusting range $H_{SW}$ of the lower contact disc (6) and a clearance adjusting range $H_{SE}$ of the upper contact disc (5) is given by $H_{SW}/H_{SE} \geqq 5$, and/or wherein a thickness variation of the upper contact disc (5) is given by $D_{maxE}/D_{minE} \leqq 1.2$, a thickness variation of the lower contact disc (6) being simultaneously given by $D_{maxW}/D_{minW} \leqq 3$.

3. A method of claim 1 wherein the upper contact disc (5) and the lower contact disc (6) have diameters $D_1$ and $D_2$ respectively in a ratio of $D_1/D_2 \geqq 3$.

4. A method of claim 1 wherein the cup tappet (1) is made of a light weight material.

5. A method of claim 1 wherein the upper contact disc (5) is made of a material selected from a group comprising of steel, engineering ceramic fiber reinforced aluminum, and particle reinforced aluminium.

6. A method of claim 1 wherein a hollow cylindrical extension extends concentrically from a cam-distal side of the bottom (4), or a bore (8) is arranged in said side of the bottom (4), the lower contact disc (6) being fixed in said extension or in said bore (8).

7. A method of claim 6 wherein the lower contact disc (6) is configured as a hollow cylindrical bushing (10) which extends in the extension or in the bore (8) and whose bottom (11) is in direct contact with an end of the stem (7) of the gas exchange valve.

8. A method of claim 6 wherein an annular element (13) is fixed in an outer peripheral surface (12) of the lower contact disc (6) or of the bushing (10), which annular element (13) positionally fixes the lower contact disc (6) or the bushing (10) relative to the extension or the bore (8).

9. A method of claim 6 wherein at least one projection (9) extends radially inwards from the extension or the bore (8) and at least partially force-locks the lower contact disc (6) or the bushing (10) relative to the extension or the bore (8).

10. A method of claim 7 wherein the bushing (10) has a height which substantially shortens a length of the valve stem (7).

11. A method of claim 2 wherein the upper contact disc (5) and the lower contact disc (6) have diameters $D_1$ and $D_2$ respectively in a ratio of $D_1/D_2 \geqq 3$.

12. A method of claim 2 wherein the cup tappet (1) is made of a light weight material.

13. A method of claim 2 wherein the upper contact disc (5) is made of a material selected from a group comprising of steel, engineering ceramic, fiber reinforced aluminum particle reinforced aluminum.

14. A method of claim 2 wherein a hollow cylindrical extension extends concentrically from a cam-distal side of the bottom (4), or a bore (8) is arranged in said side of the bottom (4), the lower contact disc (6) being fixed in said extension or in said bore (8).

15. A method of claim 7 wherein an annular element (13) is fixed in an outer peripheral surface (12) of the lower contact disc (6) or of the bushing (10), which annular element (13) positionally fixes the lower contact disc (6) or the bushing (10) relative to the extension or the bore (8).

16. A method of claim 7 wherein at least one projection (9) extends radially inwards from the extension or the bore (8) and at least partially force-locks the lower contact disc (6) or the bushing (10) relative to the extension or the bore (8).

* * * * *